US005891065A

United States Patent [19]

Cariapa et al.

[11] Patent Number: 5,891,065

[45] Date of Patent: Apr. 6, 1999

[54] MOBILE EXTREMITY PUMPING APPARATUS

[75] Inventors: Vikram Cariapa, Franklin; Dean C. Jeutter, Grafton; Shih-Kang Liang, Waukesha, all of Wis.

[73] Assignee: Spinal Cord Society, Fergus Falls, Minn.

[21] Appl. No.: 690,611

[22] Filed: Jul. 31, 1996

[51] Int. Cl.[6] ..... A61H 7/00

[52] U.S. Cl. ..... 601/152; 601/151; 601/150; 601/149

[58] Field of Search ..... 601/148, 149, 601/150, 151, 152; 128/DIG. 20

[56] References Cited

U.S. PATENT DOCUMENTS

| | | | |
|---|---|---|---|
| 3,734,087 | 5/1973 | Sauer et al. . | |
| 3,853,118 | 12/1974 | Schendel . | |
| 3,866,604 | 2/1975 | Curless et al. | 601/152 |
| 4,122,837 | 10/1978 | Leonard . | |
| 4,331,133 | 5/1982 | Arkans . | |
| 4,370,975 | 2/1983 | Wright . | |
| 4,502,470 | 3/1985 | Kiser et al. . | |
| 4,624,244 | 11/1986 | Taheri . | |
| 4,989,589 | 2/1991 | Pekanmaki et al. | 601/152 |
| 5,014,681 | 5/1991 | Neeman et al. | 128/DIG. 20 |
| 5,031,604 | 7/1991 | Dye . | |
| 5,083,551 | 1/1992 | Addison, Jr. | 128/33 |

FOREIGN PATENT DOCUMENTS

| | | |
|---|---|---|
| 1250293 | 8/1986 | U.S.S.R. . |
| 93/12708 | 7/1993 | WIPO . |

OTHER PUBLICATIONS

Airaksinen, Kolari, Herve, Holopainen, "Treatment of Post–Traumatic Edema in Lower Legs Using Pneumatic Intermittent Compression," Scan J. Rehab Med, 1988, vol. 20, pp. 25–28.

Airaksinen, Partanen, Kolari, Soimakallio, "Intermittent Pneumatic Compression Therapy in Posttraumatic Lower Limb Edema: Computed Tomography and Clinical Measurements," Arch Phys Med Rehabil, Aug. 1991, vol. 72, pp. 667–670.

Allenby, Calnan, Pflug, "The Use of Pneumatic Compression in the Swelling Legs," Physiological Society, Feb. 1973, pp. 65–66.

Beninson, Levin, Santiago, Paparao, Bobola, "Use of Intermittent Pneumatic Compression in Hemodialysis," Proc Dialysis Transplant Forum, 1974, vol. 4, pp. 209–213.

(List continued on next page.)

*Primary Examiner*—Richard J. Apley
*Assistant Examiner*—Benjamin Koo
*Attorney, Agent, or Firm*—Palmatier, Sjoquist, Voigt & Christensen, P.A.

[57] ABSTRACT

The present invention is a vehicle having a mobile extremity pumping apparatus mounted thereon. The mobile extremity pumping apparatus comprises a control module, a driver module and one or more compression units. A two-layer bladder assembly is positioned between the inner layer and the outer shell comprising precompression and compression bladder layers. The precompression bladder layer extends longitudinally along the person's extremity with the individual bladders each wrapping around and arranged sequentially along the extremity. The precompression bladder layer is surrounded by a compression bladder layer mounted between the precompression bladder layer and the outer shell. A pump in the driver module compresses the media, which may be water, air, or similar media, and directs the compressed media to a manifold for distribution to each valve in the driver module. A control processor unit in the control module is connected to each valve in the driver module and further connected to each pressure sensor in the driver module to monitor the pressure in each bladder in the two-bladder layer assembly.

28 Claims, 6 Drawing Sheets

OTHER PUBLICATIONS

Baulleu, Baiulier, Vailant, "Factorial Analysis in Radionuclide Lymphography: Assessment of the Effects of Sequential Pneumatic Compression," Lymphology, Dec. 1989, vol. 22, No. 4 pp. 178–185.
Griffin, Newsome, Stralka, Wright, "Reduction of Chronic Posttraumatic Hand Edema: A Comparison of High Voltage Pulsed Current, Intermittent Pneumatic Compression, and Placebo Treatment," Physical Therapy, May 1990, vol. 70, No. 5, pp. 279–286.
Mulder, Robison, Seeley, Study of Sequential Compression Therapy in the Treatment of Non–Healing Chronic Venous Ulcers; Wounds: A Compendium of Clinical Research and Practice, vol. 2, No. 3, May/Jun. 1990, pp. 110–115.
Pekanmäki, Kolari, Kiistala, "Intermittent Pneumatic Compression Treatment for Post–Thrombotic Leg Ulcers," Clinical and Experimental Dermatology, 1987, vol. 12, pp. 350–353.
Pekanmäki, Kolari, "Sequential and Graded Intermittent Pneumatic Compression Device for Treatment of Swollen Limbs," Biomedizinische Technik, 1987, vol. 32, pp. 50–54.
Richmand, D.M., O'Donnell, T.F. Jr. and Zelikovski, A., "Sequential Pneumatic Compression for Lymphedema," Arch Surg, Oct. 1985, vol. 120, pp. 1116–1119.
Smith, P.D., Sarin, S., Hasty, J. and Scurr, J.H., "Sequential Gradient Pneumatic Compression Enhances Venous Ulcer Healing: A Randomized Trial," Surgery, St. Louis, Nov. 1990, vol. 108, No. 5, pp. 871–875.
M. K. Sorenseon, "The Edematous Hand," Physical Therapy, 1989, vol. 69, pp. 1059–1064.
I. Sedborg, Effectiveness of Combined Methods of Physiotherapy for Post–Mastectomy Lymphoedema: Scand J. Rehab Med, 1980, vol. 12, pp. 77–85.
Camp International, Inc., "Hemaflo: The Right Choice When Intermittent or Sequential Compression is Indicated," 1986, 6 pp.
Camp, "A Lifetime of Innovative Treatment," Lympha Press, Nov. 1990, 20 pp.
Chattanooga Corporation, "Chronic Venous Insufficiency: Second Only to Arthritis as a Cause of Disability," 1990, 4 pp.
Huntleigh, "Flowpress Home Care Compression Systems," 1990, 18 pp.
Jobst Institute, "Product Info—Jobst Air Band Pneumatic Pressure Bandage," 1974, 3 pp.
Kendall, Healthcare Products Company, "The Home RX Vascular Compression System," 1991, 2 pp.
Talley, Multicom, "Intermittent & Sequential Compression Systems," 6 pp.
Wright Linear Pump, Inc., "Compression Therapy that Works in Harmony with the Natural Return Circulation," 1988, 16 pp.
O. Airaksinen, MD, "Changes in Posttraumatic Ankle Joint Mobility, Pain, and Edema Following Intermittent Pneumatic Compression Therapy," Arch Phys Med Rehabil, Apr. 1989, vol. 70, pp. 341–344.
O. Airaksinen, M.D, P. Kolari, MSc, H, Miettinen, MD, "Elastic Bandages and Intermittent Pneumatic Compression Treatment of Acute Ankle Sprains," Arch Phys Med Rehabil, May 1990, vol. 71, pp. 380–383.
M.R. Bastien, B.G. Goldstein, J.L. Lesher, J.G. Smith, "Treatment of Lymphedema with multicompartmental pneumatic compression device," Journal of the American Academy of Dermatology, pp. 853–854.
L.T. Cotton, V.C. Roberts, "The Prevention of Deep Vein Thrombosis with Particular Reference to Mechanical Methods of Prevention," Surgery, Feb. 1977, vol. 81, No. 2, pp. 228–235.
A. Francois, J.Y. Bouchet, A. Franco and M. Comet, "Does Medical Treatment of Lymphedema Act by Increasing Lymph Flow6," VASA, 1989, Heft 4, pp. 281–286.
J.A. Feedar, L.C. Kloth, G.D. Gentzkow, "Chronic Dermal Ulcer Healing Enhanced with Monophasic Pulsed Electrical Stimulation," Physical Therapy, Sep. 1991, vol. 71, No. 9, pp. 639–649.
J.R. Hardy, "Lymphoedema—Prevention rather than cure," Annals of Oncology, 1991, vol. 2, pp. 532–533.
E.Z. Hazarika, M.T.N. Knight, A. Franzer–Moodie, "The Effect of Intermittent Pneumatic Compression on the Hand After Fasciectomy," The Hand, 1979, vol. 11, No. 3., pp. 309–314.
J.M. McCulloch, "Intermittent Compression for the Treatment of a Chronic Stasis Ulceration," Physical Therapy, Oct. 1991, vol. 61, No. 10, pp. 1452–1453.
M. Mridha and S, Odman, "Fluid Translocation Measurement," Scand J. Rehab Med, 1989, vol. 21, pp. 63–69.
G. Newman, "Which Patients with Arm Oedema are Helped by Intermittent External Pneumatic Compression Therapy," Journal of the Roual Society of Medicine, Jul. 1988, vol. 81, pp. 377–379.
J.K. Raines, T.F. O'Donnell, L. Kallsher and R.C. Darling, "Selection of Patients with Lymphedema for Compression Therapy," The American Journal of Surgery, Apr. 1977, vol. 133, pp. 430–437.
A. Zelikovski, A. Deutsch and R. Reiss, "The Sequential Pneumatic Compression Device in Surgery for Lymphedema of the Limbs," J. Cardiovasc. Surg., 1983, vol. 24, pp. 122–126.
I. Swedborg, "Voluminometric Estimation of the Degree of Lymphedema and its Therapy by Pneumatic Compression," Scand J. Rehab Med, 1977, vol. 9, pp. 131–135.
I. Swedborg, "Effects of Treatment with an Elastic Sleeve and Intermittent Pneumatic Compression in Post–Mastectomy Patients with Lymphoedema of the Arm," Scand J Rehab Med, 1984, vol. 16, pp. 35–41.
Derwent—Dialog OnSearch, Computer Printout, Jun. 19, 1996.

MOBILE EXTREMITY PUMPING APPARATUS

BACKGROUND OF THE INVENTION

The present invention relates to medical devices for reducing edema and increasing circulation in the extremities of people suffering from spinal cord injuries or otherwise confined to ambulatory devices such as wheelchairs. People suffering from injuries such as spinal cord injuries which confine the person to wheelchairs may suffer from edema. Edema is caused by the flow of plasma fluid out of the cardiovascular system through capillary walls in the blood vessels and into the tissue surrounding the blood vessels. Some of the plasma fluid is reabsorbed into the cardiovascular system through an elaborate system of collecting vessels, called the lymphatic system. The plasma fluid which enters the tissue and is reabsorbed into the cardiovascular system is referred to as lymph. The blood and plasma fluid in the cardiovascular system is circulated through the extremities by the pumping action of muscles in a person's extremities. Proper functioning of the lymphatic system and the muscle pump system ensures that excess lymph will not accumulate in the lower extremities and assures proper blood circulation.

An accumulation of excessive lymph leads to edema with side effects of pain, fibrotic tissue changes, dermal ulceration, infection and possibly a loss of a limb. When trauma or paralysis prevents a person from exercising the legs, the natural pumping action of the calf muscles is lost and the result can be lymphedema and tissue fibrosis.

People who suffer from spinal cord injuries or are recovering from surgeries are more likely to be sedentary and suffer from lymphedema. Lymphedema can also lead to more serious effects such as venous stasis with secondary deep venous thrombosis (DVT) in turn DVT may lead to life threatening pulmonary embolism.

Typically edema may be relieved by raising the lower extremities above the waste level. This elevation of the extremities allows the edema to subside naturally, however, the person must remain in that position for a period of time. Edema is ideally treated upon occurrence. Delayed treatment can cause discomfort, can lead to more lengthy treatment and can lead to further complications. In order to allow people confined to a wheelchair to spend extended periods in the sitting position, a wheelchair having a system for the detection of edema and manipulation of the extremities to reduce excessive lymph in the tissues is needed. Any compression system on the extremities should not be unsightly.

The present invention is designed to provide detection and treatment of edema for persons restricted to a vehicle such as a wheelchair for long periods of time without requiring the person being returned to a predetermined location for treatment of the edema.

SUMMARY OF THE INVENTION

The present invention is a vehicle having a mobile extremity pumping apparatus mounted thereon. The mobile extremity pumping apparatus comprises a control module, a driver module and one or more compression units. An outer shell may be used to surround the compression unit and a soft fabric inner layer may be placed between the compression unit and the person's extremity. The outer shell may utilize different fabrics which match the user's apparel. A two-layer bladder assembly is positioned between the inner layer and the outer shell comprising precompression and compression bladder layers. The precompression bladder layer extends longitudinally along the person's extremity with the individual bladders each wrapping around and arranged sequentially along the extremity. The precompression bladder layer is surrounded by a compression bladder layer mounted between the precompression bladder layer and the outer shell. The individual bladders in each bladder layer have overlapping edges to assure a uniform pressure is placed on the extremity. The bladders in the precompression bladder layer are each connected to a pressure sensor in the driver module. Each bladder in the precompression bladder layer is further connected to a valve in the driver module for controlling the flow of a compression media into each respective bladder. Each bladder in the compression bladder layer is similarly connected to a valve in the driver module and a pressure sensor in the driver module. A pump in the driver module compresses the media, which may be water, air, or similar media, and directs the compressed media to a manifold for distribution to each valve in the driver module. A control processor unit in the control module is connected to each valve in the driver module and further connected to each pressure sensor in the driver module to monitor the pressure in each bladder in the two-bladder layer assembly. The control processor also controls the flow of media into each bladder for maintaining a preset pressure in the precompression bladder layer and monitors pressure changes in the precompression bladder layer caused by the expansion of the extremity due to the onset of edema. The control processor unit may sequentially control each individual bladder in the compression bladder layer to provide a compression wave effect along the extremity of the person to urge the flow of fluids from the distal end of the extremity to the proximal end of the extremity.

An advantage of the present invention is that it allows extended sitting in the wheelchair.

A further object of the present invention is a mobile extremity pumping apparatus which may be moved from a wheelchair to an automobile or other ambulatory means for the person.

Yet another object of the present invention is a mobile extremity pumping apparatus which may be easily disassembled and reassembled for cleaning or maintenance.

A feature of the present invention is an edema sensing and treatment apparatus mounted on a wheelchair.

Another feature of the present invention is a plurality of sequentially positioned and supported overlapping bladders surrounding an extremity of the person for treatment of edema.

Another feature of the present invention is a fabric-like outer shell which may be removed, cleaned and interchanged with other shells to provide an aesthetically pleasing appearance.

Another feature of the present invention is quick disconnects on the individual bladders in the edema treatment apparatus for quick disassembly.

Another feature of the present invention is a mid-foot bladder in the bladder assembly for comfortably fitting around a foot on a person's leg.

Another feature of the present invention is a heel bladder in the edema treatment system for comfortably fitting the heel of a person's foot.

Another feature of the present invention is a toe and leg bladder for comfortably fitting the toe portion and the leg of a person.

Another feature of the present invention is the power supply may be a battery on the wheelchair or a cigarette lighter plug for using the electrical system in an automobile.

Another feature of the present invention is the overlapping edges of adjacent bladders in each layer to guarantee compression of the covered portion of the leg or extremity.

Another feature of the present invention is the bladders are supported in the overlapping configuration to continuously engage the extremity along the length of the pumping apparatus and to provide a smooth compressive wave along the extremity.

Another feature of the present invention is the system may utilize liquids or air as a compression media.

Another feature of the present invention is the profile of the housing is minimized by placing the valves and the pressure sensors in the driver module.

Another feature of the present invention is alarm signals may be generated to indicate the apparatus has detected the onset of edema or compression of the bladders may be automatically commenced upon the sensing of edema.

Another feature of the present invention is the control module may control the individual pressurization of each bladder in the compression unit to provide sequential compression of the extremity from the distal end to the proximal end.

Another feature of the present invention is the control module may be programmed to provide gradient sequential compression of the extremity.

An advantage of the present system is the bladder assemblies may be easily removed and replaced from the housing.

Another advantage of the present invention is that components in the mobile extremity pumping apparatus are easily cleanable.

Another advantage of the present invention is the outer shell may be replaced by other fabric-type materials to match clothes worn by the person.

DETAILED DESCRIPTION OF THE PREFERRED EMBODIMENTS

Figure 9:
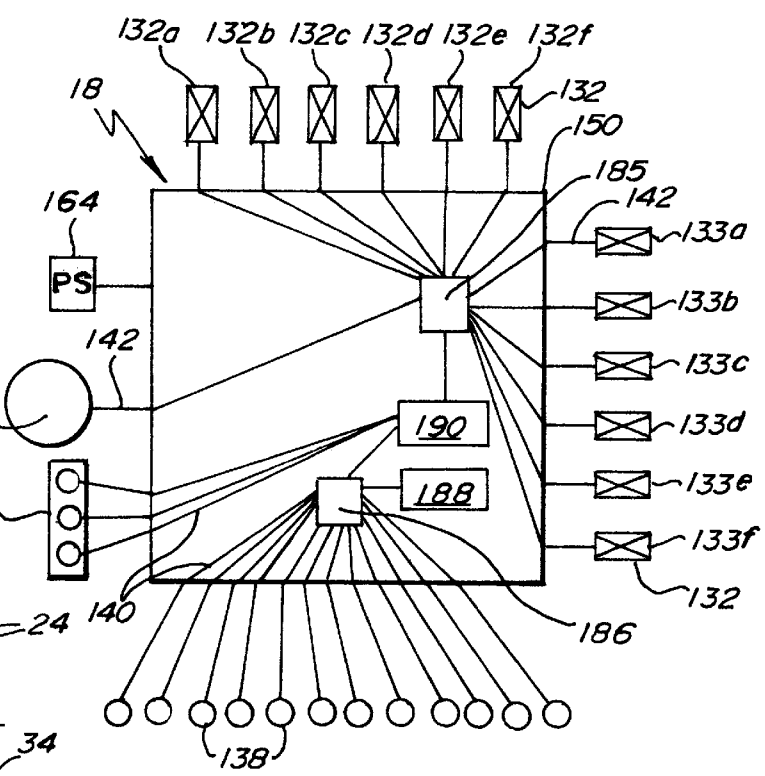
FIG. 9 is a schematic view of the control module.

The present invention comprises a device 11 for supporting a person 22 and detecting and treating edema in the person's extremity 24 comprising a mobile extremity pumping apparatus 10 on a vehicle 12 on wheels 161. The mobile extremity pumping apparatus 10 may be mounted on a wheelchair 14 and comprise a pumping portion 15 connected to a control portion 18 and a driver portion 20.

Figure 1:
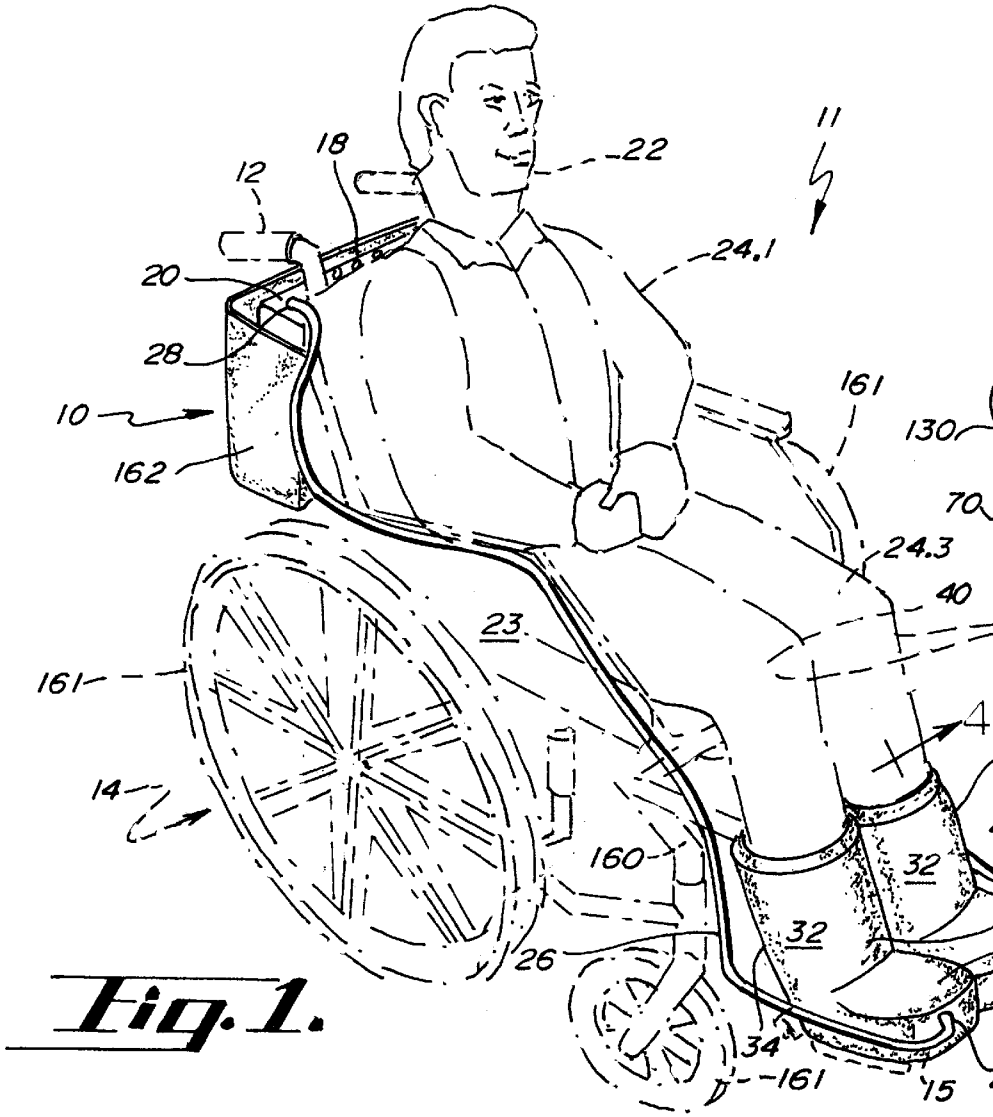
FIG. 1 is a perspective view of a person in a wheelchair having the mobile extremity pumping apparatus mounted thereon.

Referring to FIG. 1, the person 22 is seated on a seat 23 on the wheelchair 14. The person 22 has an extremity 24 which is engaged by the pumping portion 15. Tubes 26 connect the pumping portion 15 to the control portion 18 and the driver portion 20. A quick disconnect connector 28 is used to connect the tubes 26 to the driver portion 20 for easy disassembly of the mobile extremity pumping apparatus 10. As shown in FIG. 1, the pumping portion 15 may be configured as a leg module 16. The pumping portion 15 may have a housing 32 having a removable shell 34 made of a non-stretch material such as nylon fabric or the like. A compression unit 30 (FIG. 2) is contained to bear against the extremity 24 of the person 22. The compression unit 30 extends sequentially along the extremity 24 as illustrated in FIG. 1 from the person's toe portion 38 to a position below the knee 40. The compression unit 30 is flexible to wrap around and engage the extremity 24 to allow each bladder 51 to wrap around the extremity 24. The compression unit 30 positions the bladders 51 to sequentially extend along the extremity 24. An edema sensor portion 42 may be a separate device (FIG. 2A) engaging the extremity 24 and located on the housing 32. The edema sensing portion 42 may be in communication with the control portion 18 for sensing the onset of edema in the extremity 24.

Figure 2:
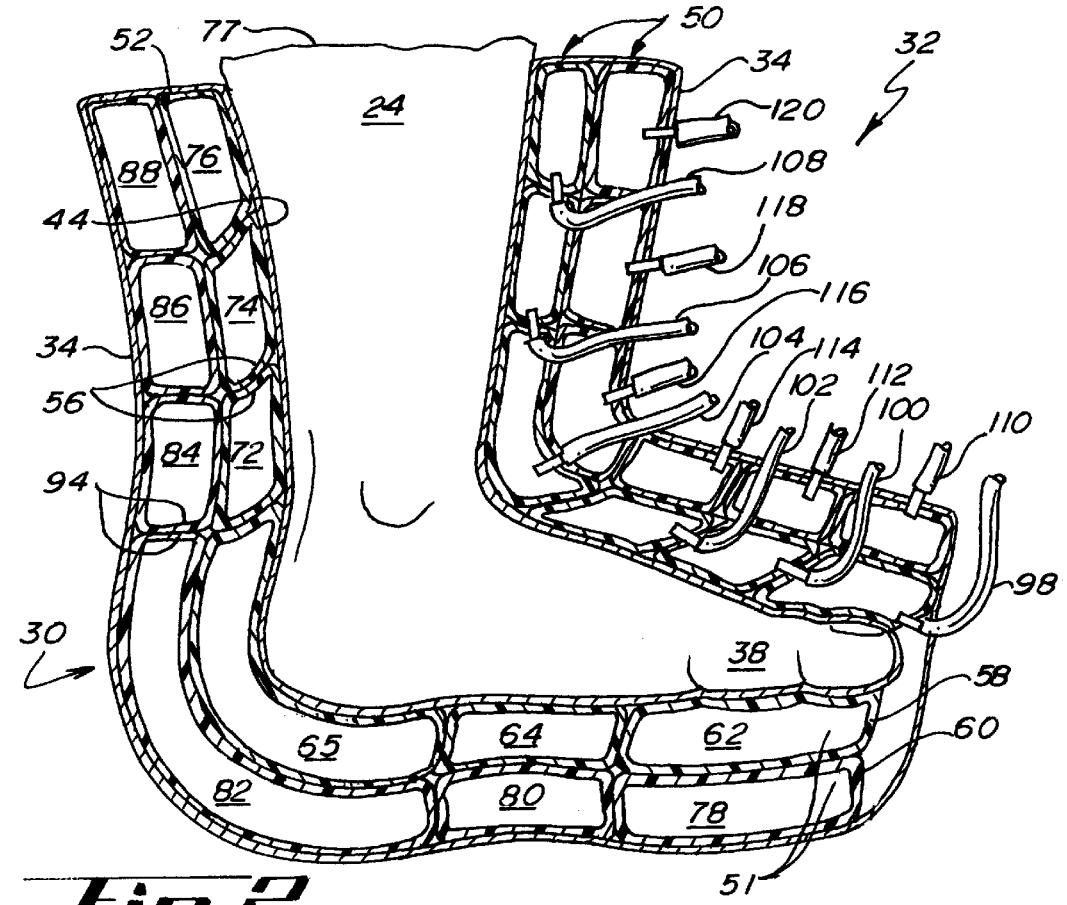
FIG. 2 is a detail section view taken at approximately 2—2 of the compression unit illustrated in FIG. 1.

Referring to FIG. 2, a cross-section of the leg module 16 is illustrated showing the compression unit 30 having a pair of inflatable bladder subassemblies 50, each made of a plurality of separately sealed and inflatable bladders 51. The compression unit 30 is flexible and configured to wrap around and engage the extremity 24 to sequentially position each bladder 51 along the extremity 24. The compression unit 30 wraps each bladder 51 lengthwise around the extremity 24 and supports the bladders 51 in an overlapping configuration along the extremity 24. Two bladder subassemblies 50 form a two-bladder layer assembly 52. Each bladder 51 has at least one side portion 54 forming an overlapping edge 56 with an adjacent bladder 51. The overlapping edges 56 may be bonded together to support the overlapping configuration. The two-bladder layer assembly 52 comprises a precompression bladder layer 58 arranged longitudinally and supported along and proximate to the extremity 24 and a compression bladder layer 60 arranged longitudinally and supported between the precompression bladder layer 58 and the shell 34. The two bladder layer subassembly 52 may extend from a distal portion 61 of the extremity 24.

Figure 2B:
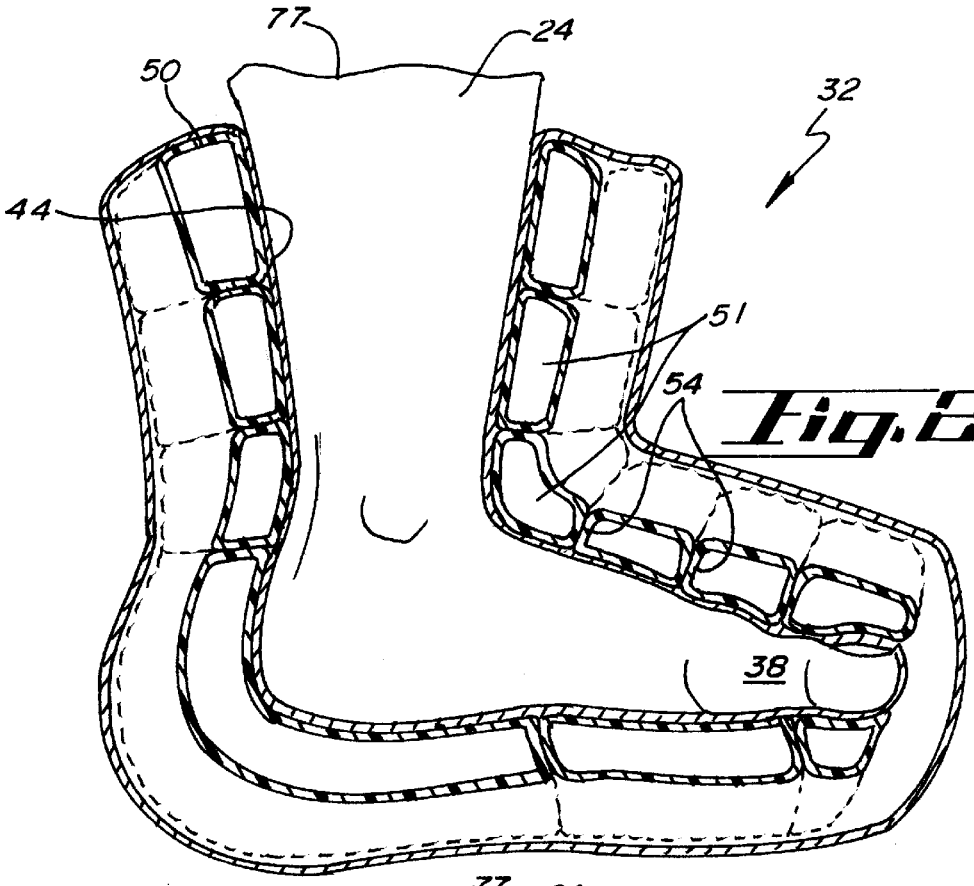
FIG. 2B is a detail section view taken at approximately 2—2 of FIG. 1 of an alternative embodiment of the compression unit.
Figure 2A:
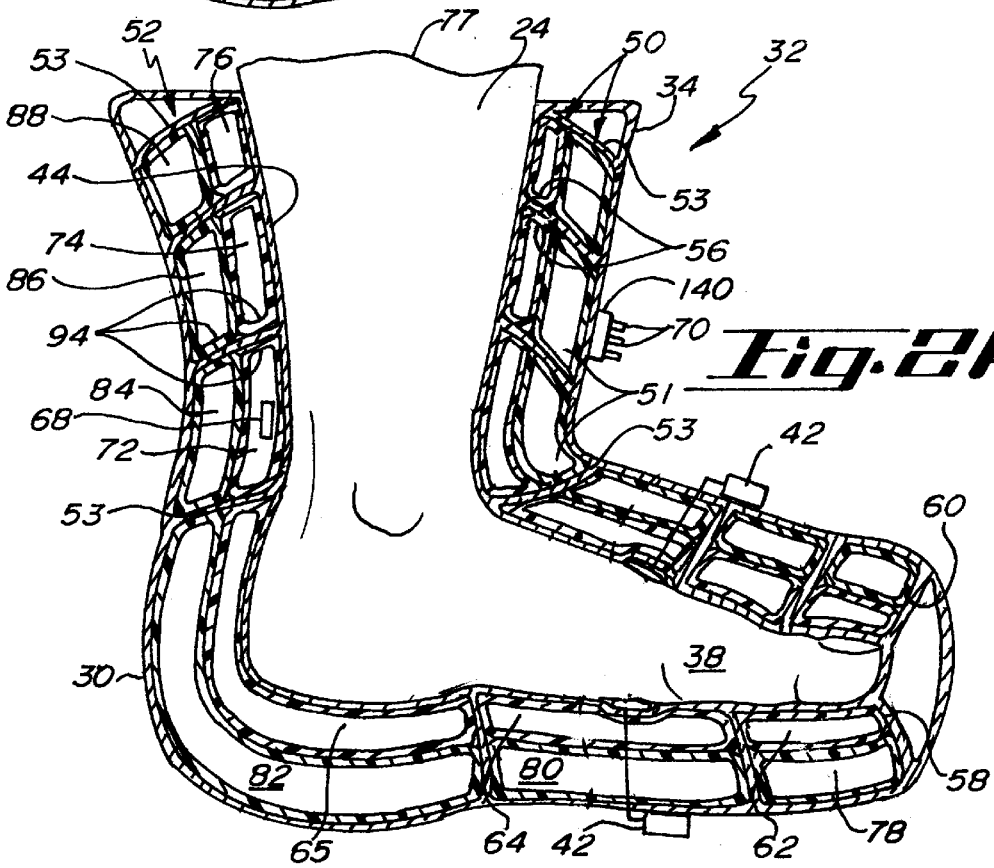
FIG. 2A is a detail section view taken at approximately 2—2 of FIG. 1 of an alternative embodiment of the compression unit.

Referring to FIG. 2A, the two bladder layer assembly 52 may be longitudinally arranged and supported along the extremity 24 by overlapping compartments 66 having walls 53 extending from the inner layer 44 to the shell 34. The walls 53 are formed in a non-perpendicular angle to the extremity 24 to form the compartments 66 in an overlapping configuration. The bladders 51 are individually inserted into the overlapping compartments 66 to form the two bladder layer assembly 52 comprising a precompression bladder layer 58 proximate to the extremity 24 and a compression bladder layer 60 between the precompression bladder layer 58 and the shell 34. In the configuration shown on FIG. 2A, the bladders 51 have side portions 54 and overlapping edges 56 positioned with respect to adjacent bladders and supported in place by the overlapping compartments 66. A pressure sensor 68 may be connected to one or more of the bladders 51 in the precompression bladder layer 58. Push buttons 70 may be mounted on the housing 32 to allow the person 22 to control the mobile extremity pumping apparatus.

Referring to FIGS. 2 and 2A, the precompression bladder layer 58 comprises a precompression toe bladder 62 proximate the distal portion 61 of the extremity 24. The precompression toe bladder 62 engages the extremity proximate to the toe portion 38. The precompression mid-foot bladder 64 is positioned adjacent the precompression toe bladder 62 and longitudinally positioned along the extremity 24 from the precompression toe bladder 62. The precompression heel bladder 65 is longitudinally positioned along the extremity 24 adjacent the precompression mid-foot bladder 64.

A first precompression leg bladder 72 is longitudinally positioned along the extremity 24 adjacent the precompression heel bladder 65. A second precompression leg bladder 74 is positioned longitudinally on the extremity 24 adjacent the first precompression leg bladder 72. Additional bladders 51 may be positioned along the extremity 24 such as third precompression leg bladder 76 positioned proximate to the second precompression leg bladder 74. The precompression bladder layer 58 extends to a proximal portion 77 of the extremity 24.

Continuing to refer to FIGS. 2 and 2A, the compression bladder layer 60 comprises a compression toe bladder 78 supported in place between the precompression toe bladder 62 and the shell 34. The compression mid-foot bladder 80 is likewise positioned between the shell 34 and the precompression mid-foot bladder 64. The compression heel bladder 82 is positioned and supported in place between the shell 34 and the precompression heel bladder 65. The compression bladder layer 60 also comprises a first, second, and third compression leg bladders 84, 86, 88 respectively, mounted sequentially along the extremity 24 and supported between the shell 34 and the first, second, and third precompression leg bladders 72, 74, 76, respectively.

Continuing to refer to FIG. 2, the bladders 51 are connected to the driver portion 20 by tubes 26 connected to a nipple 90 on each bladder 51. The nipples 90 may have a quick disconnect connector 92 on the outside of each bladder 51. Each bladder 51 is made of a substantially inelastic sheet material 94 (FIG. 7) such as a twelve (12) gauge frosty clear. The nipple 90 extends through the sheet material 94 to provide fluid communication between the driver portion 20 and the interior of each bladder 51.

Continuing to refer to FIG. 2, the tubes 26 connecting each bladder 51 in the two-bladder layer assembly 52 to the driver portion 20 comprise a first precompression tube 98 connected to the precompression toe bladder 62, a second precompression tube 100 connected to the precompression mid-foot bladder 64 and a third precompression tube 102 connected to the precompression heel bladder 65. A fourth, fifth, and sixth precompression tubes 104, 106, 108 respectively, connect to the first, second, and third precompression leg bladders 72, 74, 76 respectively.

Continuing to refer to FIG. 2, a first compression tube 110 connects the compression toe bladder 78 to the driver portion 20. Likewise, the second compression tube 112 connects to the compression mid-foot bladders 80 and the third compression tube 114 connects to the compression heel bladder 82. Similarly, a fourth, fifth, and sixth compression tubes 116, 118, 120 connect to the first, second, and third compression leg bladders 84, 86, 88 respectively. The tubes 26 may be fabricated from plastic tubing such as the TYGON® brand, manufactured by Norton Performance Plastics Corporation, P.O. Box 3660, Akron, Ohio 44309-3660. Each tube 26 connects between the quick disconnect connector 92 on each individual nipple 90 and the quick disconnect connector 28 on the driver portion 20.

Referring to FIG. 2B, the compression unit 30 is illustrated as a single layer comprising a bladder subassembly 50. As illustrated in FIG. 2B, the bladders 51 in the bladder subassembly 50 may have side portions 54 which are not overlapping with a side portion 54 of an adjacent bladder 51.

Figure 3:
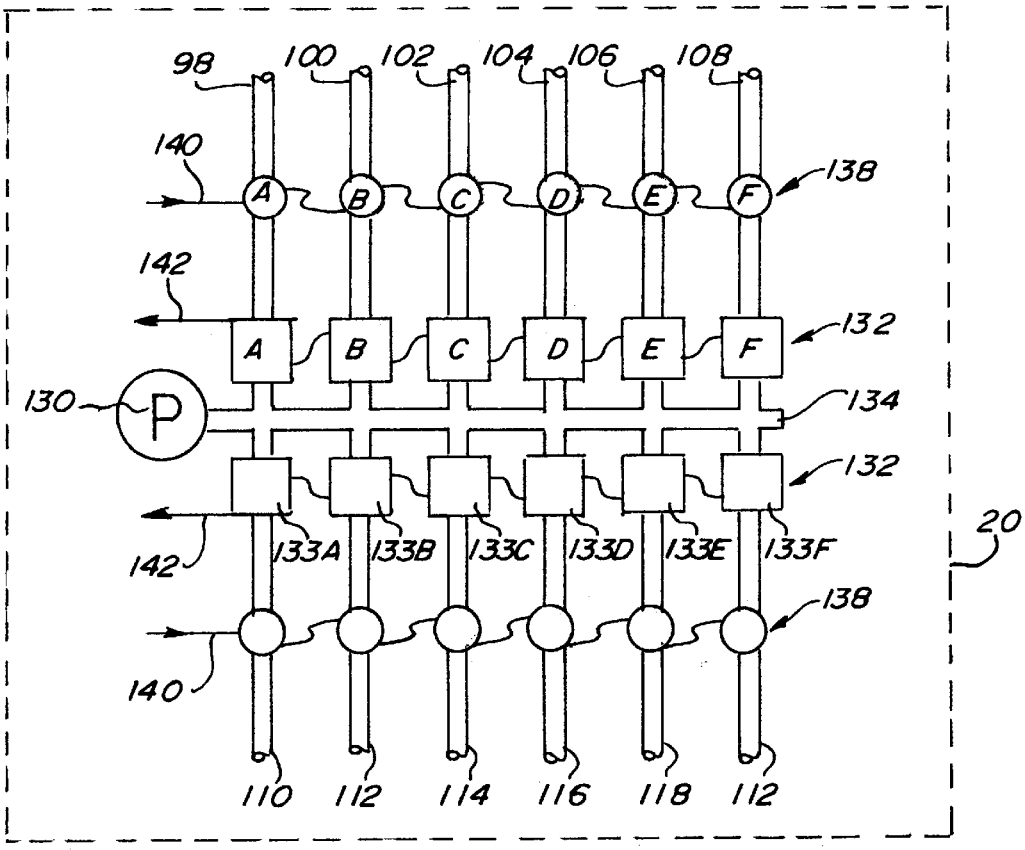
FIG. 3 is a perspective view of the driver module.

Referring to FIG. 3, a detail of the driver portion 20 is illustrated comprising a pump 130 connected to a plurality of valves 132 by a supply manifold 134. The pump 130 is suitable for pumping a compression media such as air or water to the bladders 51 as described below. The valves 132 are electrically activated by a signal from the control portion 18. The valves 132 may be a three-way valve 132 for filling, holding and draining the compression media to and from the bladders 51 such as Model No. D311 from SIRAI Elettromeccanica at Strada Per Cernusco, 19-20060 Bussero-Milano, Italy. The valves 132 may comprise an individual valve 132 *a–f* in fluid communication with first precompression tube 98, second precompression tube 100, third precompression tube 102, fourth precompression tube 104, fifth precompression tube 106, and sixth precompression tube 108 respectively to control the flow of the compression media to each bladder 51 in the precompression bladder layer 58. described above. Likewise, the valves 132 may further comprise valves 133 *a–e* in communication with each bladder 51 in the compression bladder layer 60 by first compression tube 100, second compression tube 112, third compression tube 114, fourth compression tube 116, fifth compression tube 118, and sixth compression tube 120 respectively. It should be understood, the valves 132 may have a one to one configuration with the bladders in the two-bladder layer assembly 52 or the bladders 51 may be interconnected into a group of bladders 51 connected to a single valve 132 depending the preference of an individual.

Pressure sensors 138 are mounted in communication with one or more bladders 51 in the two-bladder layer assembly 52 to monitor the pressure of the compression media in the connected bladder 51. A pressure sensor 138 may be mounted in fluid communication with each valve 132 to monitor the pressure in each individual or interconnected group of bladders 51. The pressure sensors 138 are connected by input electrical cables 140 to the control portion 18 and are configured to send a signal to the control portion 18 proportional to the sensed pressure. Each valve 132 and the pump 130 are connected to the control portion by output electrical cables 142.

Figure 4:
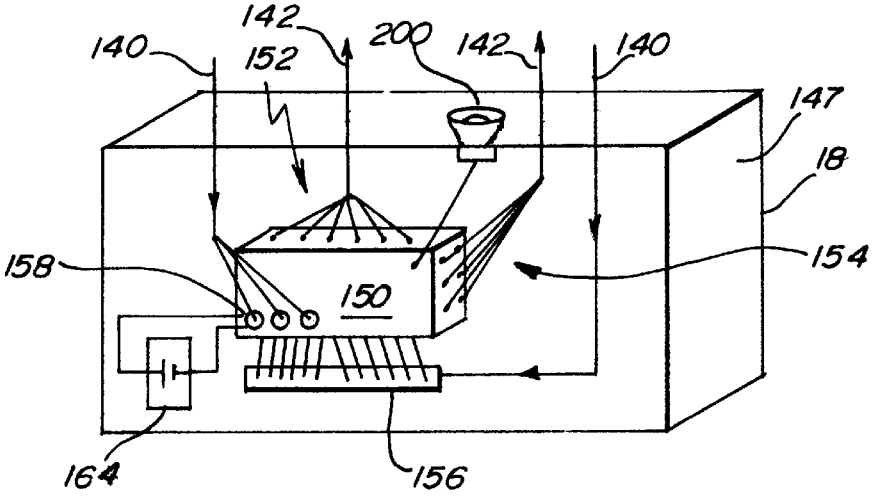
FIG. 4 is a perspective view of the control module.

Referring to FIG. 4, the control portion 18 is illustrated as a separate control module 147 having an enclosure 148 and a control processor unit 150. The control processor unit 150 comprises precompression outputs 152 connected to output electrical cables 142. Each individual precompression output 152 is connected to a single valve 132 between the pump 130 and the precompression bladder layer 58. A plurality of compression outputs 154 are on the control processor unit 150 and individually electrically connected to each valve 132 in communication with a bladder 51 in the compression bladder layer 60. It should be understood, the precompression outputs 152 and the compression outputs 154 each have an individual connection through the output electrical cable 142 to their respective valve 132. The control processor unit 150 also comprises a plurality of pressure sensor inputs 156 individually electrically connected to the pressure sensors 138 for monitoring the pressures in the two-bladder layer assembly 52. The push buttons 70 are electrically connected to the push button inputs 158 by input electrical cables 140. A power supply 164 supplies power to the control processor unit 150 to control actuation of each individual valve 132 and power for the pressure sensors 138 for generating a signal proportional to the pressure detected in a respective connected bladder 51.

Figure 5:
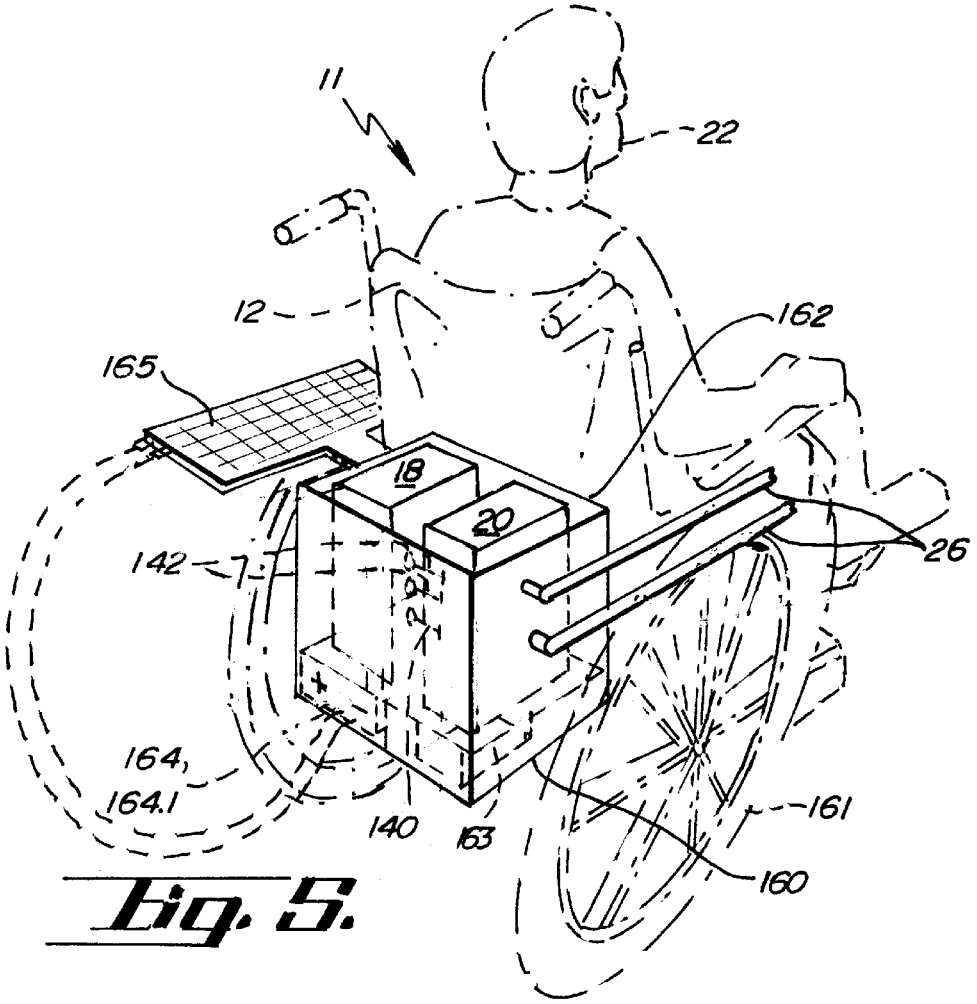
FIG. 5 is a perspective view of the mobile extremity pumping apparatus mounted on a wheelchair.

Referring to FIG. 5, the mobile extremity pumping apparatus 10 is shown comprising a support structure 160 on the wheelchair 14 having a plurality of wheels 161 rotatably mounted thereon. The wheels 161 engage and roll along the ground to allow the wheelchair 14 to support and move the person 22. The control portion 18 and driver portion 20 are contained in a rack 162 mounted to the support structure 160 of the wheelchair 14. A reservoir 163 may be attached to the support structure 160 if the compression media is a fluid such as water. The power supply 164 may comprise a battery 164.1 mounted in the rack 162. The power supply 164 may further comprise a solar panel 165 connected to the battery 164.1 for recharging the battery 164.1.

Figure 6:
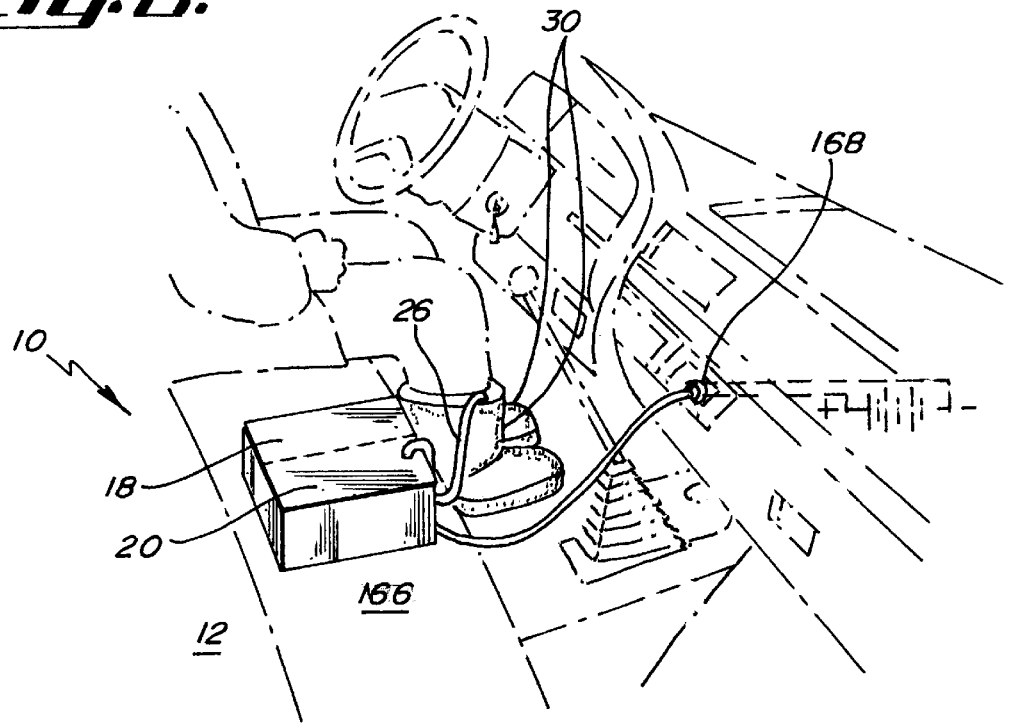
FIG. 6 is a perspective view of the mobile extremity pumping apparatus being used in an automobile.

Referring to FIG. 6, the mobile extremity pumping apparatus 10 may comprise a vehicle 12 such as an automobile having a car seat 166 supporting the control portion 18 and the driver portion 20. In this embodiment, the power supply 164 is configured to have a cigarette lighter connection 168 for connecting to the electrical system of the automobile. The person 22 may ride in or operate the automobile having a compression unit 30 removably mounted on one or more extremity 24.

Figure 7:
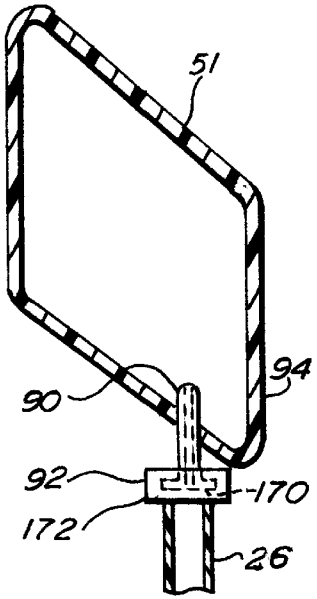
FIG. 7 is a detail view illustrating the quick disconnect nipples.

Referring to FIG. 7, the nipple 90 is illustrated having quick disconnect connector 92 extending into a bladder 51. The quick disconnect connector 92 may comprise a ridge 170 on the nipple 90 and a press-on connector 172 on the tube 26 illustrated connected to a bladder 51 in the precompression bladder layer 58. The quick disconnect connector 92 may alternatively comprise other configurations and apparatus well known in the art of quick disconnect fluid communication connectors such as quarter-turn connectors.

Figure 8:
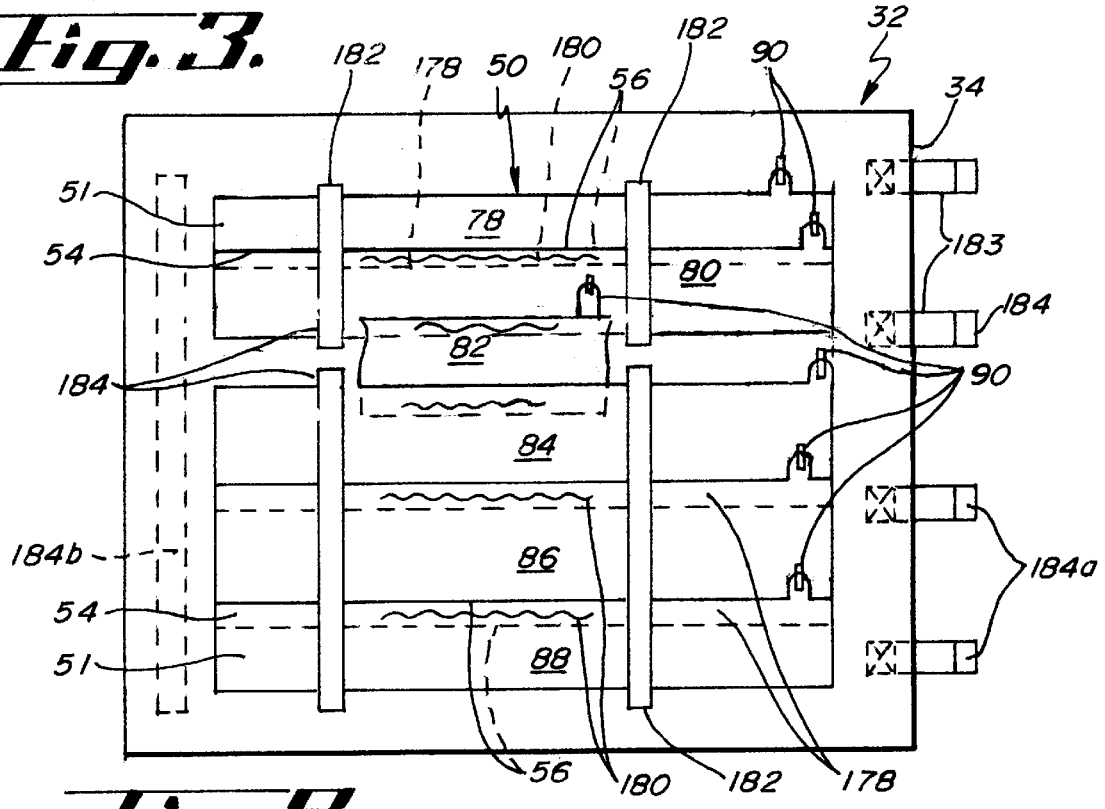
FIG. 8 is a side elevation view illustrating the compression bladder layer attached to the shell of the housing.

Referring to FIG. 8, a bladder subassembly 50 is illustrated attached to the shell 34 on the housing 32. The compression bladder layer 60 is illustrated to show an overlapping configuration having bonded side portions 54 with overlapping edges 56 forming the overlapping configuration between bladders 51. The overlap portion 178 comprises a bond 180 of an adhesive or a heat formed bond for attaching the side portions 54 of adjacent bladders 51 together. Support straps 182 may be used to support the bladder subassembly 50 in place. A second bladder subassembly 50 may be placed on top of the bladder subassembly 50 illustrated, to form a two-bladder layer subassembly 52 (FIG. 2). A releasable wrapping strap 183 may be positioned at several locations along the shell 34 for releasably wrapping the shell 34 about the extremity 24. The releasable wrapping strap 183 and the support straps 182 further comprise a releasable fastener 184 such as a hook material 184*a* and a complimentary loop material 184*b* for releasably fastening. It should be understood, the fastener 184 may be alternative releasable fasteners such as snaps, hooks, buttons, or other releasable fasteners known in the art of fastening.

Referring to FIG. 9, a schematic layout of the control portion 18 is illustrated showing the connections between the control processor unit 150 and the valves 132, the pressure sensors 138, the pump 130, and the control push buttons 70. The control processor unit 150 comprises a memory portion 188 connected to a circuitry portion 190 which is connected to and controlling an output portion 185 and an input portion 186. The circuitry 190 is configured to monitor the inputs coming into the input portion 186 from the control push buttons 70 and the pressure sensors 138 and control the pump 130 and valves 132 by output portion 186 to direct the compression media from the pump 130 to the valves 132 and into each the bladders 51 in the two-bladder layer assembly 52. The circuitry and components of the control processor unit are conventional such as was disclosed in U.S. Pat. No. 5,437,610 which is incorporated herein by reference.

Figure 10:
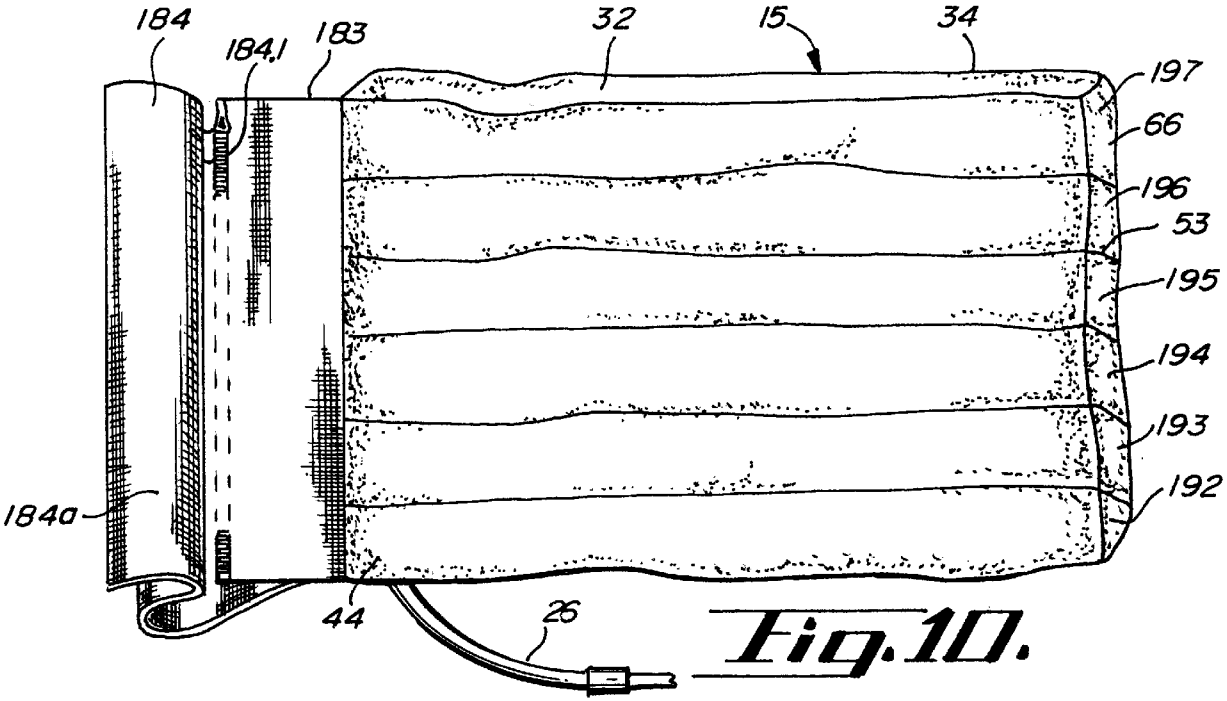
FIG. 10 is an elevational view of the compression unit illustrated in FIG. 2A.

Referring to FIG. 10, the housing 32 of the configuration illustrated in FIG. 2A is shown having a plurality of overlapping compartments 66. The tubing 26 extends from the housing 32 for connection to the driver portion 20. The releasable wrapping strap 183 is illustrated as a flap extending along the edge of the housing 32. The fastener 184 on the wrapping strap 183 for releasably wrapping the housing 32 around the extremity 24 is illustrated further comprising a zipper 184.1 between the housing 32 and the fastener 184 for easy tightening or loosening of the housing 32 by a small amount. The overlapping compartments 66 are illustrated as a toe compartment 192, a mid-foot compartment 193, a heel compartment 194, and a first, second, and third leg compartment 195, 196, 197 respectively. Each compartment is separated from adjacent compartments by a wall 53 formed at a non-perpendicular angle to the shell 34 to hold the bladders in an overlapping configuration.

Referring to FIGS. 1, 2, 3 and 4 in operation, the compression unit 31 is releasably wrapped about the extremity 24. The tubing 26 is used to connect the driver portion 20 to each bladder 51 in the pumping portion 15. The edema sensor portion 42 is configured to detect a swelling of the extremity 24 indicating the onset of edema. The edema sensor portion 42 may comprise a separate device or alternately comprise one or more pressure sensors connected to the precompression bladder layer and the circuitry 190 in the control processor unit 150 configured to detect swelling in the extremity indicating the onset of edema by monitoring the pressure sensors 138 in communication with the precompression bladder layer 58. The zipper 154.1 (FIG. 10) may be opened allowing the housing 32 to be wrapped about the extremity 24 and releasably attached with the fastener 184. The zipper 184.1 may be zipped to a closed position to snugly fit the housing 32 about the extremity 34.

Continuing to refer to FIGS. 1, 2, 3 and 4, the power supply 164 is connected to the control portion 18. The mobile extremity pumping apparatus 10 may be automatically activated or manually activated by the person 22 engaging a button 70 to initiate control of the pumping portion 15. The circuitry 190 and the control processor unit 150 is configured to energize the pump 130 causing the compression media to be pumped from the pump 130 through the supply manifold 134 to the valves 132. The circuitry 190 in the control processor unit 150 is further configured to control the valves 132 *a–e* connected to the bladders 51 in the precompression unit 58 to fill each bladder 51 in the precompression bladder layer 58 to a predetermined pressure level for compressing the extremity 24. When the bladders 51 and the precompression bladder layer 58 have reached a specified pressure as measured by the pressure sensors 138, each valve 132 is closed to sustain the pressure in the precompression bladder layer 58.

Continuing to refer to FIGS. 1, 2, 3 and 4, the pressure sensors 138 and the means for sensing edema comprising the edema sensor portion 42 are monitored by the control portion 18 to detect an increase in pressure in the extremity 24 indicating the existence of edema. Edema causes an increase in diameter in the extremity 24 thus compressing outward the surrounding bladders 51 in the precompression bladder layer 58 causing an increase in the pressure level in one or more of the bladders 51. Upon sensing of a specified increase in pressure, a pressurization sequence is commenced. The control processor unit 150 operates to sequentially open the valves 132 connected to the compression bladder layer 60 to direct the compression media from the pump 130 to each bladder 51 in the compression bladder layer 60. The bladders 51 in the compression bladder layer 60 are inflated and expand to compress the extremity 24 by bearing against the precompression bladder layer 58 and directing the pressure of the inflatable bladders 51 inwardly onto the portion of the extremity 24 adjacent each individual bladder 51.

Continuing to refer to FIGS. 1, 2, 3 and 4, the control processor unit 150 begins with the valve 132 connected to the bladder 51 in the compression bladder layer 60 proximate to the most distal portion 61 of the extremity 24, specifically as illustrated herein, the valve 133*a* connected to the compression toe bladder 78. The valve 133*a* remains open until the pump 130 has pumped a compression media into the compression toe bladder 78 to create a predetermined pressure on the toe portion 38 as measured by a pressure sensor 138 in communication with the first compression tube 110. The valve 133*a* is then closed to hold the pressure in the compression toe bladder 78. The circuitry 190 in the control processor unit 150 then sequentially controls the valve 133*b* connected to the compression midfoot bladder 80 to likewise fill the bladder to a predetermined compressive pressure as measured by the pressure sensor 138 in communication with the second compression tube 112.

Continuing to refer to FIGS. 1, 2, 3 and 4, the control processor unit 150 follows this procedure sequentially for the compression heel bladder 82, the first compression leg bladder 84, the second compression leg bladder 86, and the third compression leg bladder 88 positioned proximate to the most proximal portion 77 of the extremity 24. This sequential compressing of bladders 51 from the most distal toe bladder 78 to the most proximal leg bladder 88 in the compression bladder layer 60 creates a compressive wave that sequentially compresses the extremity 24 from the most distal portion 61 to the most proximal portion 77. After a specified delay, the circuitry 190 in the control processor unit 150 may stop the pump 130 and command the valves 132 connected to preselected bladders 51 in the compression bladder layer 60 to release the pressure in the bladders 51 in the compression bladder layer 60. The pressure may be released in a preselected sequence of bladders 51 by activating the valves 132 to drain the compression media from the bladder 51. After a second specified delay, the sequence may be repeated to form another sequential, compressive wave along the extremity 24.

Referring to FIGS. 2 and 4, after each sequential, compressive wave, the pressure sensors 138 may indicate an increase or reduction in the edema. The pressure sensors 138 monitor the edema intermediate each compression sequence. As should be understood, if the precompression bladder layer 58 is compressed at a specified precompression level, the pressure in the individual bladders 51 in the precompression bladder layer 58 should return to the specified precompression level after the pressure in the compression bladder layer 60 is released. If the pressure in the precompression bladder layer 58 is elevated after release of the pressure in the compression bladder layer 60, swelling of the extremity 24 is detected and the sequential compression wave may be repeated by the control processor unit 150. The overlapping edges 56 of the adjacent bladders 51 provide continuous pressure against the extremity 24 by the precompression bladder layer 58 and minimize gaps between individual bladders 51.

Referring to FIGS. 2 and 4, the control processor unit 150 may be programmed to provide a pressure gradient on the extremity 24 where each bladder 51 in the precompression bladder layer 58 has a pressure slightly different than an adjacent bladder 51. Preferably, the bladders 51 closer to the distal portion 61 of the extremity 24 will have a greater pressure than an adjacent, more proximal bladder 51. This gradient can be provided during the compression sequence and/or during the period the compression sequence is not occurring.

Referring to FIGS. 2 and 9, the memory portion 188 of the control processor unit may accept programming to offer extreme flexibility and detection of desired pressure increases for detecting edema and in pressurizing the bladders 51 to specified pressure profiles along the extremity 24. Additionally, flexibility provided in the timing of the compression sequences allowing predetermined delays to be specified for each step in the sequence of the precompression of the extremity 24 and the generation of a sequential compressive wave. The compression unit 30 may be adapted for attachment and compression of upper extremities as 24.1 well as a lower extremity 24.3. Furthermore, the housing 32 may be adapted to engage an extremity 24 having a distal portion 61 extending from the housing 32. The outer shell 34 may be used to restrict the outward expansion of the compression unit 30 or may alternatively be decorative to cover the compression unit 30.

Referring to FIGS. 2B and 3, the invention may also be practiced with a one-bladder layer assembly 50 having overlapping edges 56 with an initial pressurization sequence to mold the bladder layer assembly 50 about the extremities 24 and a second sequential pressurization sequence wherein each bladder 51 of the bladder assembly 50 is further pressurized in a selected sequence, preferably from the most distal portion 61 to the most proximal portion 77 to form a sequential compressive wave on the extremity 24. Pressure sensors 138 may be connected to each bladder 51 in such a configuration.

Furthermore, the individual bladders 51 in the precompression bladder layer 58 may be connected together and controlled by a single valve 132 for creating a uniform precompression pressure on the extremity 24. The single pressure sensor 138 connected to the precompression bladder layer 58 could be used in this configuration for detecting a swelling of the extremity 24 indicating edema. Furthermore, as illustrated in FIG. 4, an alarm 200 may be connected to the control processor unit 150 for audio indication of status in the control processor unit. For example, the alarm 200 may indicate a signal when edema is detected, an alternate signal indicating the compression sequence, and further alarm signals as desired by an individual.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A mobile extremity pumping apparatus for a person having an extremity, the apparatus comprising:

a) a support structure for holding the person;

b) wheels rotatably attached to the support structure;

c) a driver portion attached to the support structure, the driver portion having a pump and a plurality of valves connected to the pump;

d) a control portion attached to the support structure, the control portion configured to control the pump and valves in the driver portion;

e) a compression unit configured to wrap around and engage the extremity, the compression unit comprising:

i) a precompression bladder layer in the compression unit proximate to the extremity, the precompression bladder layer having a plurality of bladders, such that each bladder has at least one adjacent bladder and wherein each bladder overlaps with an adjacent bladder in the precompression layer, the precompression bladder layer arranged for wrapping around and extending along the extremity, the bladders in the precompression bladder layer in communication with the pump, at least one of the plurality of valves in the driver portion connected for controlling at least one bladder in the precompression layer; and ii) a compression bladder layer having a plurality of bladders such that each bladder has at least one adjacent bladder and wherein each bladder overlays with an adjacent bladder, the compression bladder layer also arranged for wrapping around and extending along the extremity, the compression bladder layer positioned adjacent the precompression bladder layer to extend over the precompression bladder layer when the compression unit is wrapped around an extremity, at least one other of the plurality of valves in the driver portion connected for controlling at least one bladder in the compression bladder layer;

f) a compression media pumpable by the pump for pressurizing the bladders; and g) a power supply connected to the control portion and the driver portion.

2. The invention of claim 1 wherein each bladder in the precompression bladder layer is bonded to an adjacent bladder.

3. The invention of claim 1 further comprising a shell surrounding the compression unit.

4. The invention of claim 3 wherein the shell comprises a series of overlapping compartments, each compartment separated from an adjacent compartment by a compartment wall, the bladders of the precompression bladder layer mounted in each compartment whereby when the compression unit is wrapped around an extremity said bladders are adjacent the extremity and the overlapping compartments hold the adjacent bladders in the precompression bladder layer in an overlapping configuration.

5. The invention of claim 4 wherein each bladder forming the compression bladder layer is mounted respectively in each overlapping compartment adjacent the precompression bladder layer opposite the extremity and the shell, the shell holding the side portions of each bladder in the compression bladder layer in an overlapping configuration with respect to an adjacent bladder in the compression bladder layer.

6. The invention of claim 1 further comprising a means for sensing edema in communication with the control portion for sensing the onset of edema in the extremity and actuating the pump, said means for sensing edema being activated by an increase in pressure in one or more of the bladders in the precompression bladder layer caused by an increase in the diameter of the extremity.

7. The invention of claim 1 further comprising a quick disconnect connector on each bladder.

8. The invention in claim 1 wherein the compression media is selected from the group consisting of water and air.

9. The invention in claim 8 further comprising a reservoir on the support structure and in communication with the pump, the reservoir holding the compression media.

10. The invention of claim 1 further comprising a pressure sensor in communication with at least one bladder in the precompression bladder layer.

11. The invention of claim 1 further comprising an edema sensing portion comprising a pressure sensor in communication with a bladder in the precompression bladder layer.

12. The invention of claim 1 wherein the extremity is a leg with a foot having a heel and toes wherein the bladders in the precompression bladder layer further comprise a toe bladder mounted proximate to the toes, a mid-foot bladder mounted proximate to the foot and a plurality of leg bladders mounted proximate to the leg of the extremity.

13. The invention of claim 12 further comprising a heel bladder mounted proximate to the heel portion adjacent to the mid-foot bladder.

14. The invention of claim 1 further comprising a control processor unit in the control portion configured to control each valve connected to the precompression bladder layer to uniformly compress the leg by directing the compression media to each bladder in the precompression bladder layer.

15. The invention of claim 1, the extremity comprising a distal portion and a proximal portion, further comprising a different valve in the driver portion connected to each bladder in the compression bladder layer, a control processor unit in the control portion electrically connected to each valve in the driver portion, the control processor unit configured to sequentially compress the extremity by directing the compression media from the pump to the bladders in the compression bladder layer such that the bladders in the compression bladder layer are filled sequentially with the compression media compressing the bladders proximate to the distal portion first and next sequentially compressing adjacent bladders to form a compressive wave from the distal portion to the proximal portion.

16. A mobile extremity pumping apparatus for a patient having an extremity, the apparatus comprising:

a) a vehicle having a support structure and a plurality of wheels rotatably mounted on the support structure for providing mobility;

b) a driver portion having a pump and a plurality of valves, the valves in fluid communication with the pump, the driver portion on the support structure;

c) a control portion on the vehicle, the control portion connected to the valves and the pump for controlling the flow of a compression media through each valve;

d) a compression unit comprising a plurality of bladders along the extremity, the bladders in fluid communication with at least one valve in the driver portion; and e) an edema sensing portion for detecting the onset of edema in an extremity, the edema sensing portion in communication with the extremity and the control portion; whereby, upon detection of edema, the edema sensing portion communicates with the control portion to pressurize the bladders of the on unit.

17. The invention of claim 14 further comprising a pressure sensor in communication with at least one bladder in the compression unit, the pressure sensor connected to the control portion.

18. The invention of claim 14 further comprising a pressure sensor in communication with at least one bladder in the compression bladder layer and connected to the control portion.

19. The invention of claim 18 wherein the control portion is configured to direct the flow of the compression media into the compression unit upon the edema sensing portion sensing a predetermined level of edema.

20. The invention of claim 16 further comprising a separate valve in the driver portion for each bladder in the compression unit for controlling the flow of the compression media between the pump and the respective bladders, a control processor unit in the control portion configured to activate the valves for sequential pressurization of the bladders from a distal portion of the extremity to a proximal portion of the extremity forming a compressive wave.

21. The invention of claim 16 further comprising a removable interchangeable shell attached to the compression unit.

22. The invention of claim 19 further comprising a removable inner fabric layer between the compression unit and the extremity.

23. The invention of claim 16 wherein the bladders in the compression unit are arranged to form a precompression bladder layer adjacent the extremity and a compression bladder layer between the precompression bladder layer and the outer shell.

24. The invention of claim 23 further comprising an edema sensing portion in communication with the precompression bladder layer.

25. The invention of claim 23 wherein each bladder in the compression bladder layer is connected to a respective valve in the driver portion and a valve connected to at least one bladder in the precompression bladder layer.

26. The invention of claim 23 further comprising a separate pressure sensor for each bladder in the compression bladder layer, each pressure sensor inserted intermediate the pump and the respective bladder in the compression bladder layer.

27. The invention of claim 17 further comprising a control processor unit in the control portion, the control processor unit connected to the pressure sensor in communication with at least one bladder in the compression unit, the control processor unit configured to detect a change in the pressure in the connected bladder caused by an increase in the diameter of the extremity indicating the onset of edema.

28. A wheelchair mobility supporting a person having an extremity in combination with a mobile extremity pumping apparatus, the mobile extremity pumping apparatus comprising:

a) a wheelchair having a support structure and a plurality of wheels rotatably mounted on the support structure;

b) a control portion having a control processor unit, a plurality of outputs and a plurality of inputs, the control processor configured to detect signals at one of the plurality of inputs and turn one or more of the plurality of outputs on or off;

c) a driver portion comprising a pump connected to one of the plurality of outputs, a plurality of valves in fluid communication with the pump, each valve connected to a respective one of the plurality of outputs in the control portion, the control processor unit configured to control the valves;

d) a flexible compression unit for removably wrapping around the extremity, the compression unit extending from a proximal portion of the extremity to a distal portion of the extremity, the compression unit having a two-bladder layer assembly comprising:

i) a precompression bladder layer having a plurality of overlapping bladders arranged proximate to the extremity and supported in position to wrap around the extremity, the bladders arranged sequentially along the extremity from the distal portion to the proximal portion, each bladder having side portions, each side portion of each bladder overlapping with adjacent side portions of adjacent bladders, at least one valve in the driver portion connected to the bladders in the precompression bladder layer, a pressure sensor in communication with at least one bladder in the precompression bladder layer;

ii) a compression bladder layer having a plurality of bladders arranged sequentially along the precompression bladder layer from the distal portion of the extremity to the proximal portion of the extremity, each bladder in the compression bladder layer connected to a respective one of the plurality of valves in the driver portion;

d) a removable outer shell for wrapping around the compression unit;

e) an edema sensing portion for sensing edema; and f) circuitry in the control processor unit in communication with the edema sensing portion and configured to sequentially compress the bladders in the compression bladder layer.

* * * * *

UNITED STATES PATENT AND TRADEMARK OFFICE

CERTIFICATE OF CORRECTION

PATENT NO. :5,891,065

DATED :April 6, 1999

INVENTOR(S) :Vikram Cariapa, et al.

It is certified that error appears in the above-identified patent and that said Letters Patent is hereby corrected as shown below:

col. 6, line 27: please delete the period after "58"

col. 8, line 40: please delete the number "154.1" and insert in its place the number --184.1-- col. 8, line 44: Please delete the number "34" and insert in its place the number --24-- col. 12, line 61: please delete the word "on" and in its place insert --compression--

Signed and Sealed this

Eighth Day of August, 2000

*Attest:*

Q. TODD DICKINSON

*Attesting Officer*

*Director of Patents and Trademarks*